US007192365B2

(12) United States Patent
Souza et al.

(10) Patent No.: US 7,192,365 B2
(45) Date of Patent: Mar. 20, 2007

(54) GOLF CLUB HEAD WITH PIXELLATED SUBSTRATE

(75) Inventors: John C Souza, Phoenix, AZ (US); David E. Wright, Glendale, AZ (US); Mustapha Hayouna, Phoenix, AZ (US); Lou C. Beebe, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 219 days.

(21) Appl. No.: 11/019,814

(22) Filed: Dec. 21, 2004
(Under 37 CFR 1.47)

(65) Prior Publication Data

US 2006/0135284 A1 Jun. 22, 2006

(51) Int. Cl.
*A63B 53/04* (2006.01)

(52) U.S. Cl. ..... 473/329; 473/340; 473/342; 473/349; 473/332

(58) Field of Classification Search ..... 473/324–350
See application file for complete search history.

(56) References Cited

U.S. PATENT DOCUMENTS

| | | | | | |
|---|---|---|---|---|---|
| 1,494,494 | A | * | 5/1924 | Lippincott | 473/342 |
| 3,847,399 | A | * | 11/1974 | Raymont | 473/350 |
| 4,679,792 | A | * | 7/1987 | Straza et al. | 473/329 |
| 4,681,322 | A | * | 7/1987 | Straza et al. | 473/329 |
| 5,060,951 | A | * | 10/1991 | Allen | 473/346 |
| 5,301,941 | A | * | 4/1994 | Allen | 473/327 |
| 5,458,332 | A | | 10/1995 | Fisher | |
| 5,482,281 | A | | 1/1996 | Anderson | |
| 5,524,331 | A | * | 6/1996 | Pond | 29/527.4 |
| 5,575,472 | A | | 11/1996 | Magerman | |
| 5,766,093 | A | * | 6/1998 | Rohrer | 473/329 |
| 5,807,190 | A | | 9/1998 | Krumme | |
| 5,842,935 | A | | 12/1998 | Nelson | |
| 6,001,030 | A | * | 12/1999 | Delaney | 473/329 |
| 6,093,116 | A | * | 7/2000 | Hettinger et al. | 473/332 |
| 6,277,033 | B1 | * | 8/2001 | Krumme et al. | 473/342 |
| 6,302,807 | B1 | * | 10/2001 | Rohrer | 473/329 |
| 6,375,583 | B1 | | 4/2002 | Solheim | |
| 6,390,932 | B1 | * | 5/2002 | Kosmatka et al. | 473/324 |
| 6,431,997 | B1 | * | 8/2002 | Rohrer | 473/324 |
| 6,478,694 | B2 | | 11/2002 | Anderson | |
| 6,592,467 | B1 | * | 7/2003 | Gray | 473/332 |
| 6,659,883 | B2 | | 12/2003 | Nelson | |
| 6,699,140 | B1 | * | 3/2004 | Sun | 473/252 |
| 6,932,716 | B2 | * | 8/2005 | Ehlers et al. | 473/329 |

* cited by examiner

*Primary Examiner*—Sebastiano Passaniti
(74) *Attorney, Agent, or Firm*—Darrell F. Marquette

(57) ABSTRACT

A golf club head has a face insert that is supported from beneath by a substrate composed of a plurality of elongate rod elements arranged in a parallel closely packed array. Because the face insert is made of a single material, the resiliency of the face insert itself does not vary across the front surface of the face insert; however, the effective resiliency of the face insert may be varied by varying the resiliency of the substrate. This is accomplished by selecting different materials and/or different overall lengths for the rod elements that comprise the substrate. Use of a substrate comprising a plurality of rod elements permits the effective resiliency of the face insert to be varied without varying the face material.

14 Claims, 3 Drawing Sheets

GOLF CLUB HEAD WITH PIXELLATED SUBSTRATE

BACKGROUND OF THE INVENTION

This invention relates generally to golf equipment and, in particular, to golf club heads.

As is well known to golf manufacturers and many golfers, the "sweet spot" of a golf club head is a point on the front face of the club head at which a line drawn normal to the front face passes through the center of gravity of the golf club head. If a golfer swings a golf club so that the club head impacts a golf ball at the sweet spot, few if any harmonic vibrations are excited within the golf club head and shaft. Consequently, the maximum amount of energy from the golfer's swing is available for momentum transfer to the golf ball. Conversely, if the golfer swings the golf club so that the club head impacts the golf ball away from the sweet spot, the impact frequently excites various torsional and bending oscillations. Such a mis-hit has two deleterious consequences. The harmonic oscillations are felt as unpleasant vibrations transmitted to the golfer's hands and the energy lost through the harmonic oscillations is not available for momentum transfer to the ball and thus results in a shorter distance of travel for the golf ball for the same swing speed. This effect is compounded by the fact that in many cases the sweet spot of the front face is at or near the point of the front face with the highest compliance and therefore, the highest effective coefficient of restitution. Thus, a golf ball hit at the sweet spot will travel substantially further than a golf ball hit at a point on the front face away from the sweet spot. To counteract this effect, it would be advantageous to provide a golf club head having a variable resiliency across the front face.

U.S. Pat. No. 5,807,190 to Krumme, et al. discloses a club head in which the face insert is composed of many small rods arranged in a closely packed array. According to the Krumme patent, use of individual rod segments to form the front face allows the properties of the front face to vary in any pattern over the impact area, simply by varying the materials out of which the individual rods are made. Use of multiple materials within the array of rods could render a front face having the desired variable resiliency. Such use of multiple materials would, however, render the club non-conforming, for Rule 5(b) of Appendix II of the United States Golf Association requires that the whole of the impact area of a club head be of the same material. Accordingly, what is needed is a golf club head in which the resiliency of the front face may be varied across the front face without varying the rod material.

SUMMARY OF THE INVENTION

The present invention comprises a golf club head having a face insert made of a single material, yet the effective resiliency of the face insert may be varied across a front surface of the face insert. According to an illustrative embodiment, a front face of a club head body has a cavity for receiving a face insert. The face insert is supported from beneath by a substrate composed of a plurality of elongate rod elements arranged in a parallel closely packed array. Because the face insert is made of a single material, the resiliency of the face insert itself does not vary across the front surface of the face insert; however, the effective resiliency of the face insert, which is the energy returned to a golf ball striking the front face of the club head body, may be varied by varying the resiliency of the substrate supporting the face insert. This is accomplished by selecting different materials and/or different overall lengths for the rod elements that comprise the substrate. Use of a substrate comprising a plurality of rod elements permits the effective resiliency of the face insert to be varied without varying the face material.

DESCRIPTION OF THE DRAWING

The present invention will be better understood from a reading of the following detailed description, taken in conjunction with the accompanying drawings figures in which like references designate like elements and, in which.

DESCRIPTION OF THE INVENTION

Figure 1:
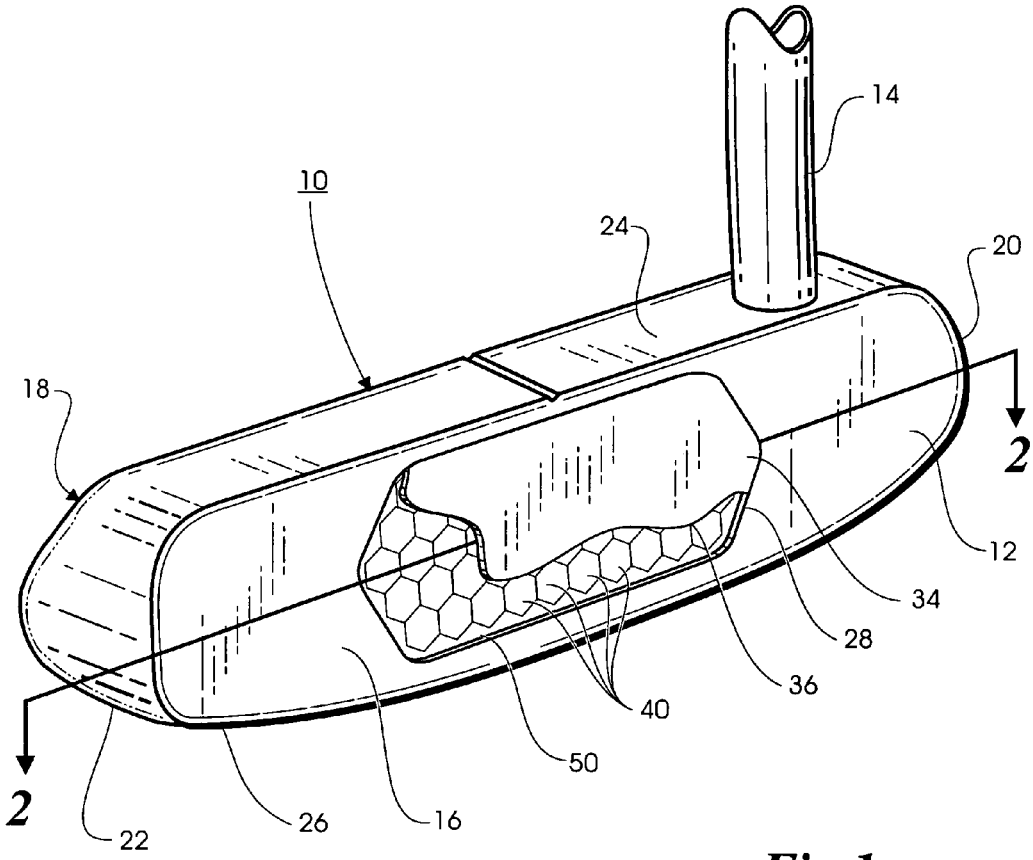
FIG. 1 is a front perspective view of a golf club head incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and the detailed description are not intended to limit the invention to the particular form disclosed but are merely illustrative and intended to teach one of ordinary skill how to make and/or use the invention claimed herein and for setting forth the best mode for carrying out the invention.

Figure 2:
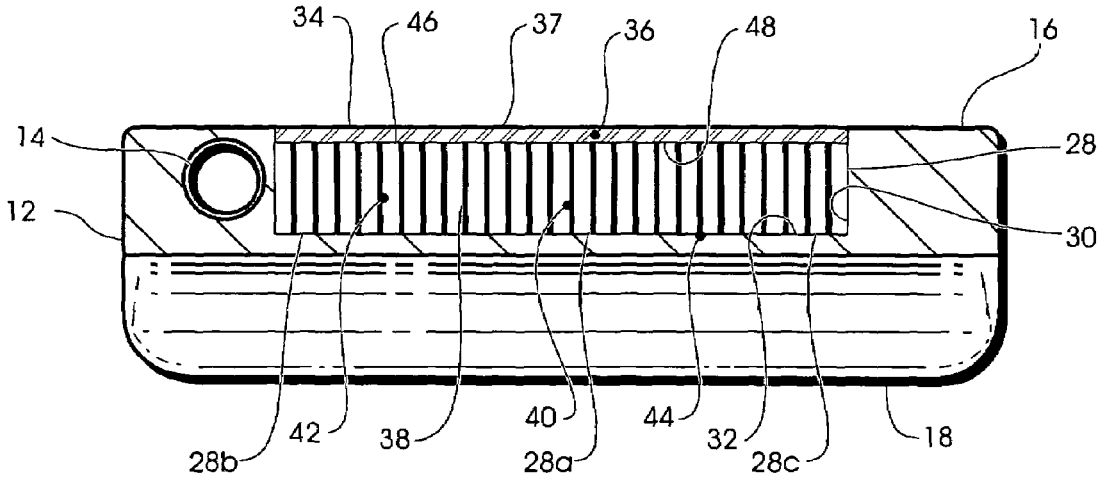
FIG. 2 is a cross-sectional view of the golf club head of FIG. 1 taken along line 2—2.

With reference to FIGS. 1 and 2, a golf club head 10 comprises a club head body 12 attached to a golf club shaft 14. Typically, the club head body 12 is made of a suitable metal such as steel formed by an investment casting process, however, other materials such as titanium, aluminum, tungsten, brass, bronze, beryllium copper, graphite epoxy or other metallic or non-metallic materials may be used without departing from the spirit and scope of the present invention. Club head body 12 has a front face 16, a rear surface 18, a heel end 20 and a toe end 22, a top rail 24 and a sole 26.

As shown most clearly in FIG. 2, club head body 12 is formed with a cavity 28 that extends from the front face 16 toward the rear surface 18 and is defined by side wall 30 and bottom wall 32. The cavity 28 includes a central region 28A and a perimeter region which consists of a heel region 28B and a toe region 28C. A striking surface 34 on the front face 16 of club head body 12 is formed by a face insert 36 supported by a substrate 38 disposed in cavity 28. Face insert 36 has a front surface 37 and is preferably a thin, planar body composed of an elastomer such as polyeruthane, however, other non-metallic materials or metallic materials may be used, provided that the interaction between the face insert 36 and the substrate 38 permits the effective resiliency of the face insert 36 to be varied by varying the resiliency of the substrate 38.

Substrate 38 preferably comprises a plurality of individual rod elements 40. Rod elements 40 are all of substantially identical geometry. Accordingly, the individual rod elements 40 are not separately described herein in detail. Rod elements 40 are packed together in an array such that each side surface 42 of each rod element 40 is in contact with a side surface 42 of an adjacent rod element 40. The bottom ends 44 of the rod elements 40 are supported by bottom wall 32 of cavity 28. Top ends 46 of the rod elements 40, in turn, support back surface 48 of face insert 36. Substrate 38 may be formed of individual rod elements of circular cross-section (not shown), but preferably comprises a plurality of rod elements having hexagonal cross-sections arranged in a hexagonal close-packed array surrounded by an epoxy binder that holds the rods in place. Rod elements 40 themselves may be made of metallic or non-metallic materials and preferably a combination of metallic and non-metallic materials to provide the desired variation in resiliency.

Figure 3:
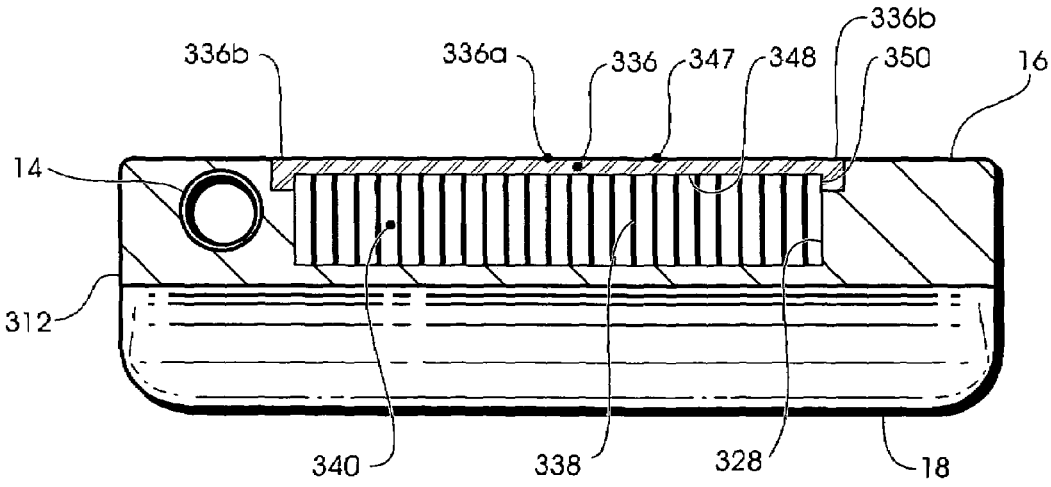
FIG. 3 is a cross-sectional view of an alternative embodiment of a golf club head incorporating features of the present invention.

As noted hereinbefore, face insert 36 may be a thin planar body, which may be adhesively bonded to substrate 38. Alternatively, as shown in FIG. 3, a face insert 336 may be formed with a cavity 350 formed in its back surface 348. The face insert 336 includes a central portion 336*a*, a perimeter portion 336*b* and a thickness dimension measured between its front and back surfaces 347, 348. As seen in FIG. 3, the thickness dimension of face insert 336 is smaller near its central portion 336*a* and larger near its perimeter portion 336*b*. Cavity 350 is sized to receive the rod elements 340 comprising substrate 338. In the illustrative embodiment of FIG. 3, the rod elements 340 are assembled to face insert 336 and the subassembly consisting of face insert 336 and substrate 338 is then inserted into the cavity 328 of club head body 312. Assembling the rod elements 340 directly to face insert 336 eliminates the need for a separate retainer to hold rod elements 340 together prior to assembly to club head 312.

Figure 4:
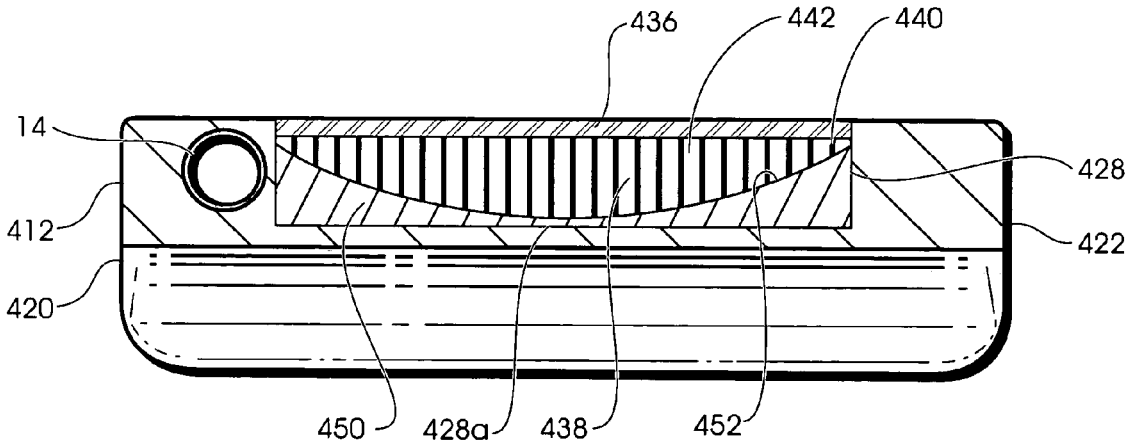
FIG. 4 is a cross-sectional view of an alternative embodiment of a golf club head incorporating features of the present invention.

With reference to FIG. 4, as noted hereinbefore the effective resiliency of the face insert 436 may be varied by varying the materials and/or the length of the individual rod elements 440 comprising the substrate 438 beneath the face insert 436. In the illustrative embodiment of FIG. 4, an additional substrate 450 supports substrate 438 within cavity 428 of club head body 412. Substrate 450 has an upper surface 452 that is contoured such that individual rod elements 440 proximal the heel end 420 and toe end 422 are shorter in length than rod elements 442 proximal a central region 428*a* of cavity 428. By varying the length of rod elements 440 and 442 alone or in combination with varying the materials out of which the rod elements 440, 442 are made, a wider range of effective resiliency at the front surface of face insert 436 can be realized.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf club head comprising:

a body having a front face, a rear surface and a cavity extending from the front face toward the rear surface, said cavity having a bottom surface;

a face insert disposed in the cavity, said face insert having a front surface and a back surface, said front surface forming a striking surface on the front face of said body;

a substrate disposed in said cavity sandwiched between the back surface of said face insert and the bottom surface of said cavity, said substrate including a plurality of elongate rod elements each having a first end, a second end and a side surface, said plurality of elongate rod elements arranged in a parallel closely packed array such that the side surface of each of said plurality of elongate rod elements is in contact with the side surface of an adjacent one of said plurality of elongate rod elements, the first ends of said plurality of elongate rod elements facing said bottom surface of said cavity and said second ends of said plurality of elongate rod elements supporting at least a portion of the back surface of said face insert; and wherein said plurality of elongate rod elements includes elongate rod elements of unequal lengths.

2. The golf club head of claim 1, wherein said substrate supports substantially all portions of the back surface of the face insert.

3. The golf club head of claim 1, wherein said face insert is formed of a first material and said substrate is formed of a second material which has a lower resiliency than said first material forming said face insert.

4. The golf club head of claim 1, wherein different ones of said plurality of elongate rod elements are formed of different materials.

5. The golf club head of claim 1, wherein said face insert is formed of a metal alloy.

6. The golf club head of claim 1, wherein said face insert is formed of an elastomer.

7. The golf club head of claim 1, wherein:

said body cavity includes a central region and a perimeter region; and said substrate includes a first group of rod elements and a second group of rod elements, said first group of rod elements located proximal said central region of said cavity and said second group of rod elements located proximal said perimeter region of said cavity.

8. The golf club head of claim 1, wherein:

said body cavity includes a central region, a heel region and a toe region; and said substrate includes a first group of rod elements and a second group of rod elements, said first group of rod elements located proximal said central region and said second group of rod elements located proximal said heel and toe regions of said cavity.

9. A golf club head comprising:

a body having a front face, a rear surface and a cavity extending from the front face toward the rear surface, said cavity having a bottom surface;

a face insert disposed in the cavity, said face insert having a front surface and a back surface, said front surface forming a striking surface on the front face of said body;

a substrate disposed in said cavity sandwiched between the back surface of said face insert and the bottom surface of said cavity, said substrate including a plurality of elongate rod elements each having a first end, a second end and a side surface, said plurality of elongate rod elements arranged in a parallel closely packed array such that the side surface of each of said plurality of elongate rod elements is in contact with the side surface of an adjacent one of said plurality of elongate rod elements, the first ends of said plurality of elongate rod elements facing said bottom surface of said cavity and said second ends of said plurality of elongate rod elements supporting at least a portion of the back surface of said face insert; and wherein the front surface of said face insert is planar and the back surface of said face insert has a cavity formed therein.

10. The golf club head of claim 9, wherein:

said face insert comprises a central portion and a perimeter portion; and said face insert has a thickness dimension measured between said front and back surfaces thereof which is smaller proximal its central portion and larger proximal its perimeter portion.

11. A golf club head comprising:

a body having a front face, a rear surface and a cavity extending from the front face toward the rear surface, said cavity having a bottom surface;

a face insert disposed in the cavity, said face insert having a front surface and a back surface, said front surface forming a striking surface on the front face of said body;

a substrate disposed in said cavity sandwiched between the back surface of said face insert and the bottom surface of said cavity, said substrate including a plurality of elongate rod elements each having a first end, a second end and a side surface, said plurality of elongate rod elements arranged in a parallel closely packed array such that the side surface of each of said plurality of elongate rod elements is in contact with the side surface of an adjacent one of said plurality of elongate rod elements, the first ends of said plurality of elongate rod elements facing said bottom surface of said cavity and said second ends of said plurality of elongate rod elements supporting at least a portion of the back surface of said face insert;

said body cavity having a central region and a perimeter region; and said substrate having a thickness dimension measured between the first and second ends of said elongate rod elements which is larger proximal the central region of said body cavity and smaller proximal the perimeter region of said body cavity.

12. The golf club head of claim 11, further comprising an additional substrate disposed in said body cavity supporting said first-mentioned substrate.

13. The golf club head of claim 12, wherein said additional substrate has a contoured upper surface so that the elongate rod elements located adjacent the central region of said body cavity are longer in length than the elongate rod elements located adjacent the perimeter region of said body cavity.

14. The golf club head of claim 13, wherein said perimeter region of said body cavity includes heel and toe regions.

* * * * *